US010094128B2

(12) United States Patent
Hartman

(10) Patent No.: US 10,094,128 B2
(45) Date of Patent: Oct. 9, 2018

(54) ADJUSTABLE HOLE COVER

(71) Applicant: Michael Hartman, Rio Vista, CA (US)

(72) Inventor: Michael Hartman, Rio Vista, CA (US)

( * ) Notice: Subject to any disclaimer, the term of this patent is extended or adjusted under 35 U.S.C. 154(b) by 0 days.

(21) Appl. No.: 15/013,781

(22) Filed: Feb. 2, 2016

(65) Prior Publication Data

US 2017/0218646 A1 Aug. 3, 2017

(51) Int. Cl.
*E04G 21/32* (2006.01)

(52) U.S. Cl.
CPC ..... *E04G 21/32* (2013.01)

(58) Field of Classification Search
CPC . E04G 21/32; E04G 21/3204; E04G 23/0203; E04G 21/24; F16L 55/1141; F16L 55/132; F16L 55/1286
See application file for complete search history.

(56) References Cited

U.S. PATENT DOCUMENTS 1,464,646 A * 8/1923 Cross ..... B65D 39/12 215/299
1,493,501 A * 5/1924 Rice ..... B65D 39/16 215/364
2,245,887 A * 6/1941 Wikander ..... F16L 55/132 138/89
2,552,917 A * 5/1951 Becker ..... B62D 25/24 220/324
3,672,532 A * 6/1972 Becker ..... B62D 25/24 138/89
4,232,493 A * 11/1980 Gray ..... E04B 5/48 52/1
4,301,629 A * 11/1981 Farr ..... B62D 25/24 217/109
4,354,332 A * 10/1982 Lentz ..... E04G 23/02 264/36.15
4,510,728 A * 4/1985 Key ..... E04G 23/0203 52/127.1
4,534,088 A * 8/1985 Ricke ..... F16B 5/0664 220/787
4,588,626 A * 5/1986 Cologna ..... B29C 73/14 156/94
4,620,407 A * 11/1986 Schmid ..... E04G 23/02 156/98
4,712,343 A * 12/1987 Dearing ..... E04F 15/024 454/370
4,718,469 A * 1/1988 Koch ..... B29C 73/06 152/370
4,807,415 A * 2/1989 Oak ..... E04B 1/72 52/101
4,820,564 A * 4/1989 Cologna ..... B29C 73/14 156/98
4,823,978 A * 4/1989 Pufpaff ..... E04F 19/00 220/787

(Continued)

*Primary Examiner* — James M Ference
(74) *Attorney, Agent, or Firm* — Steins & Associates, P.C.

(57) ABSTRACT

An Adjustable Hole Cover. One size of hole cover will accommodate a wide variety of hole diameters, and fit snugly. The device is made from a lightweight, yet durable material. A version having a cap with an internal metal core is also available. The cover costs less than prior plugs by incorporating a durable cap element to which a low-cost stem is attached. The stem is selected from a group of different-sized stems made from a low-cost material, such as wood.

10 Claims, 8 Drawing Sheets

(56) References Cited

U.S. PATENT DOCUMENTS 4,932,179 A * 6/1990 Sosinski ..... E04B 1/6804 220/234
5,035,266 A * 7/1991 Benson ..... F16L 55/132 138/89
5,046,223 A * 9/1991 Kraus ..... F16B 21/086 24/297
5,103,615 A * 4/1992 Owens ..... E04B 1/72 52/169.14
5,297,691 A * 3/1994 Bottcher ..... E04B 5/48 138/89
5,499,737 A * 3/1996 Kraus ..... F16B 21/086 138/89
5,503,181 A * 4/1996 Kennedy ..... E03F 5/0407 137/362
5,528,867 A * 6/1996 Thompson ..... E04G 21/142 52/125.2
5,611,181 A * 3/1997 Shreiner ..... E04B 1/6803 404/47
5,687,528 A * 11/1997 Rouch ..... E04G 23/0203 52/514
5,845,442 A * 12/1998 Strehlow ..... E02D 29/14 220/287
6,189,573 B1 * 2/2001 Ziehm ..... F16L 55/1141 138/104
6,360,779 B1 * 3/2002 Wagner ..... F16L 55/105 138/89
6,390,007 B1 * 5/2002 Walker ..... B63B 13/00 114/183 R
6,453,603 B1 * 9/2002 Baker ..... A01M 1/2011 43/124
6,461,235 B2 * 10/2002 Rutler ..... F24F 13/085 454/289
6,494,463 B1 * 12/2002 Rank ..... E04G 23/0203 138/89
6,575,827 B1 * 6/2003 Rutler ..... F24F 13/085 454/289
6,662,490 B1 * 12/2003 Aesch, Jr. ..... A01M 1/24 43/124
6,682,257 B1 * 1/2004 Zappe ..... E02D 29/14 404/25
6,745,530 B2 * 6/2004 Nesbitt ..... E04H 17/20 52/300
6,749,499 B1 * 6/2004 Snyder ..... F24F 13/085 454/284
6,769,834 B1 * 8/2004 Stange ..... E02D 29/1409 404/25
7,559,717 B2 * 7/2009 Salas ..... E03B 7/095 220/787
7,581,361 B1 * 9/2009 Murkland ..... E04B 1/72 220/800
7,797,892 B2 * 9/2010 Cannistraro ..... F16L 5/04 138/89
7,905,068 B2 * 3/2011 Waters, Jr. ..... E04C 5/163 52/125.5
8,661,758 B2 * 3/2014 Longhenry ..... E04G 23/0203 264/46.4
8,672,178 B2 * 3/2014 Siragusa ..... B62D 25/24 220/789
8,689,488 B2 * 4/2014 Rodrigue ..... E01C 9/083 404/25
8,814,254 B1 * 8/2014 Peffley ..... B62D 25/209 296/183.1
8,959,863 B2 * 2/2015 Gray ..... E04G 23/0285 52/169.5
9,441,367 B2 * 9/2016 de Freitas Silvestre ..... E04B 5/48
2002/0102381 A1 * 8/2002 McClurg ..... E04G 23/0203 428/78
2005/0000973 A1 * 1/2005 Sbongk ..... F16J 13/14 220/802
2005/0116060 A1 * 6/2005 Borunda ..... E04G 21/3204 239/152
2007/0056088 A1 * 3/2007 DeGooyer ..... E03C 1/20 4/613
2007/0113490 A1 * 5/2007 Boyd ..... E04G 21/3204 52/133
2007/0237580 A1 * 10/2007 Sulak ..... E02D 29/1427 404/25
2008/0075532 A1 * 3/2008 Boyd ..... E02D 17/10 404/25
2008/0168719 A1 * 7/2008 Borunda ..... E04G 21/3204 52/20
2008/0216432 A1 * 9/2008 Cannistraro ..... F16L 5/04 52/514.5
2008/0236691 A1 * 10/2008 Roll ..... F16L 55/1141 138/92
2009/0249720 A1 * 10/2009 Murauchi ..... E04G 21/3204 52/302.7
2009/0320391 A1 * 12/2009 Stubblefield ..... E04G 23/0203 52/220.1
2011/0088917 A1 * 4/2011 Lee ..... A62C 2/06 169/45
2011/0258834 A1 * 10/2011 Allen ..... F16L 55/132 29/525
2013/0000771 A1 * 1/2013 Beaton ..... E03C 1/021 138/96 R
2014/0260013 A1 * 9/2014 de Freitas Silvestre .. F16L 5/14 52/220.8
2014/0270943 A1 * 9/2014 Blackowicz ..... E02D 29/14 404/25
2014/0326324 A1 * 11/2014 Berube ..... F16L 55/1286 137/12
2017/0218646 A1 * 8/2017 Hartman ..... E04G 21/32 49/463

* cited by examiner

ADJUSTABLE HOLE COVER

This application is a continuation-in-part of application Ser. No. 14/841,250, filed Aug. 31, 2015 (which claims priority to Provisional Application Ser. No. 62/191,150, filed Jul. 10, 2015.

BACKGROUND OF THE INVENTION

1. Field of the Invention

This invention relates generally to construction safety apparatus and, more specifically, to a Hole Cover.

2. Description of Related Art

Large construction projects involving the erecting of multi-floored commercial buildings generally include the structural feature of poured concrete floors. The concrete floors provide excellent durability and stability, and furthermore, allow great flexibility in configuring and re-configuring interior walls, because the vast majority of them are non-structural. However, the use of concrete for the floors includes some inherent challenges during the completion stages of the building (as well as during later improvement projects). Once the concrete has been poured and cured, it is difficult and expensive to cut new holes or penetrations through them. In order for required plumbing, wiring, and other infrastructure components to pass between building levels, it is necessary that numerous penetrations be provided through the concrete floors. Consequently, quite a number of penetrations are created in the forms prior to the concrete being poured. Until the interior (typically non-structural) walls are built, therefore, virtually all of these penetrations are out in the open. These open penetrations would provide a great safety risk to workers at the site during construction (e.g. tripping and falling); this risk is prohibited by regulation, and regular site inspections will result in citation if unprotected penetrations are discovered.

As shown in FIG. 1, a partial cutaway side view of the generic concrete floor 10, a penetration 12 is a generally circular bore formed to extend between the top surface 11A and the bottom surface 11B of the floor 10. The floor 10 typically has a thickness T(F) of between four and six inches (4" to 6"). Penetrations 12 can be of a variety of diameters D(P), depending upon their intended purpose, but they generally range between two (2) inches and eight (8) inches in diameter. It is not uncommon that there be several hundred of these penetrations 12 in any multi-level commercial building. As discussed above, each of these penetrations 12 must be covered in order to prevent personal injuries or citations from inspectors.

There have been several attempts over the years at solving the expense and inconvenience of plugging (and unplugging) these floor penetrations 12. One example was presented by P. D. Becker in U.S. Pat. No. 2,552,917. The "Universal Plug Button" of Becker is a simple device defined by two components—the cap 24 (designed to cover the penetration in the deck 22), and the fastener members 26 extending beneath the deck 22 (or wall). The problem with the Becker device is that its two-part design includes fastener members 26 formed from one piece of spring-type metal, while the cap 24 is made from a hardened metal to insure that it is of the requisite durability. The fact that these two elements are made from treated metal adds substantial cost to the device 20. Due to the sheer number of penetrations [12] that need to be plugged, it is critical to maintain the lowest per-item cost as is possible. Also, the Becker design is not sufficiently adjustable to differently-sized holes [12]—this means that the builder must have a whole range of sizes of buttons 20, with each particular size of button 20 only suitable for one diameter of hole/penetration [12].

Another prior device is the "Stopper Device" of Wagner, et al., U.S. Pat. No. 6,360,779. This device is depicted in perspective view in FIG. 3. The stopper device 30 is a single molded piece, presumably made from plastic. The cap member 32 sits above the floor [10] when the device 30 is inserted into a penetration [12]. There is a cross-shaped stem 34 extending vertically down from the bottom of the cap member 32. Along the length of the stem 34 are a plurality of "radial vanes" 36. These radial vanes 36 are designed to flex (i.e. curl up) as the stem 34 is inserted into the penetration [12]. The spring force exerted against the walls of the penetration [12] by the curled vanes 36 will serve to center the device 30 on the penetration [12], and to retain it in position. There are at least two problems, however, with the Wagner device 30. First, the design of the vanes 36, while better than those of Becker, are still limited in their ability to accommodate to a wide variety hole diameters D(P)—if the hole is too small, the vanes 36 will not be able to curl sufficiently to allow the stem 34 to be inserted into the hole [12]. Also, the curled vanes 36 will create a force that opposes the removal of the device 30 from the hole [12]. This will not only make removal of the device 30 difficult, but it will tend to cause undesirable wear and tear on the vanes 36, which will lead to a shorter service life than is desirable.

Murkland, U.S. Pat. No. 7,581,361, depicted in FIG. 4, discloses yet another version of plugs for holes in concrete floors. The Murkland "plug" has a cap and four rigid "vanes" that extend down from the cap. The Murkland plug is retained within the hole because the outer edges of the vanes are slightly farther apart than the diameter of the hole being plugged. The base portion 44 is integrated and/or attached to the head portion 42, and so it can only fit a single-sized hole. A series of projections 46 are provided in order to create a space between the top of the slab [10] to accept a prying device therein to remove the plug 40 from the hole [12].

What is needed is a simple, low-cost, durable cover for penetrations in concrete floors that can each accommodate a range of hole diameters, and be installed and removed easily and quickly.

SUMMARY OF THE INVENTION

In light of the aforementioned problems associated with the prior devices, it is an object of the present invention to provide an Adjustable Hole Cover. One size of hole cover should accommodate a wide variety of hole diameters, and fit snugly. The device should be made from a lightweight, yet durable material. A version having a cap with an internal metal core should also be available. The cover should be lower cost than prior plugs by incorporating a durable cap element to which a low-cost stem can be attached. The stems should be pre-made in varying diameters so that the user can select a suitable stem and attach it to a hole cover larger than the hole.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Adjustable Hole Cover.

Figure 1:
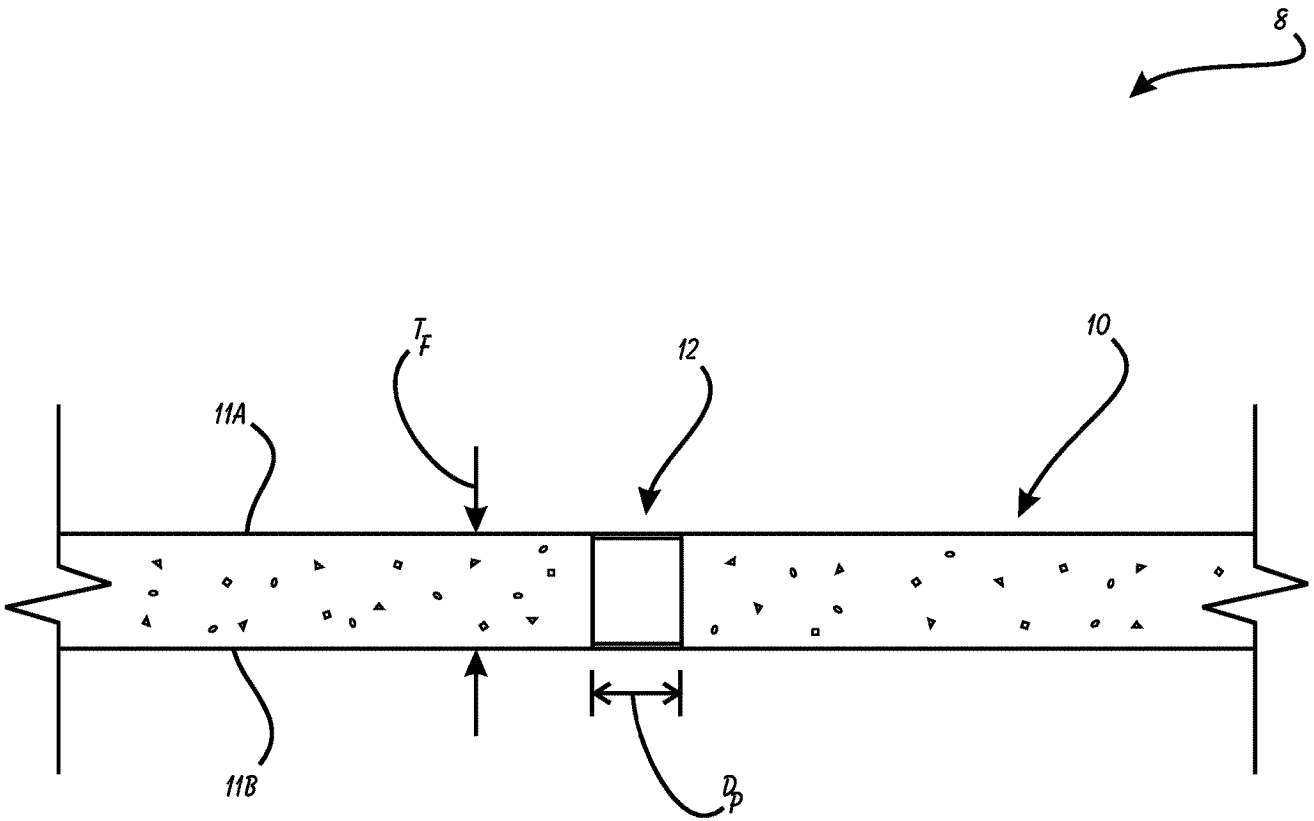
FIG. 1 PRIOR ART
FIG. 1 is a partial cutaway side view of a typical commercial building level.
Figure 2:
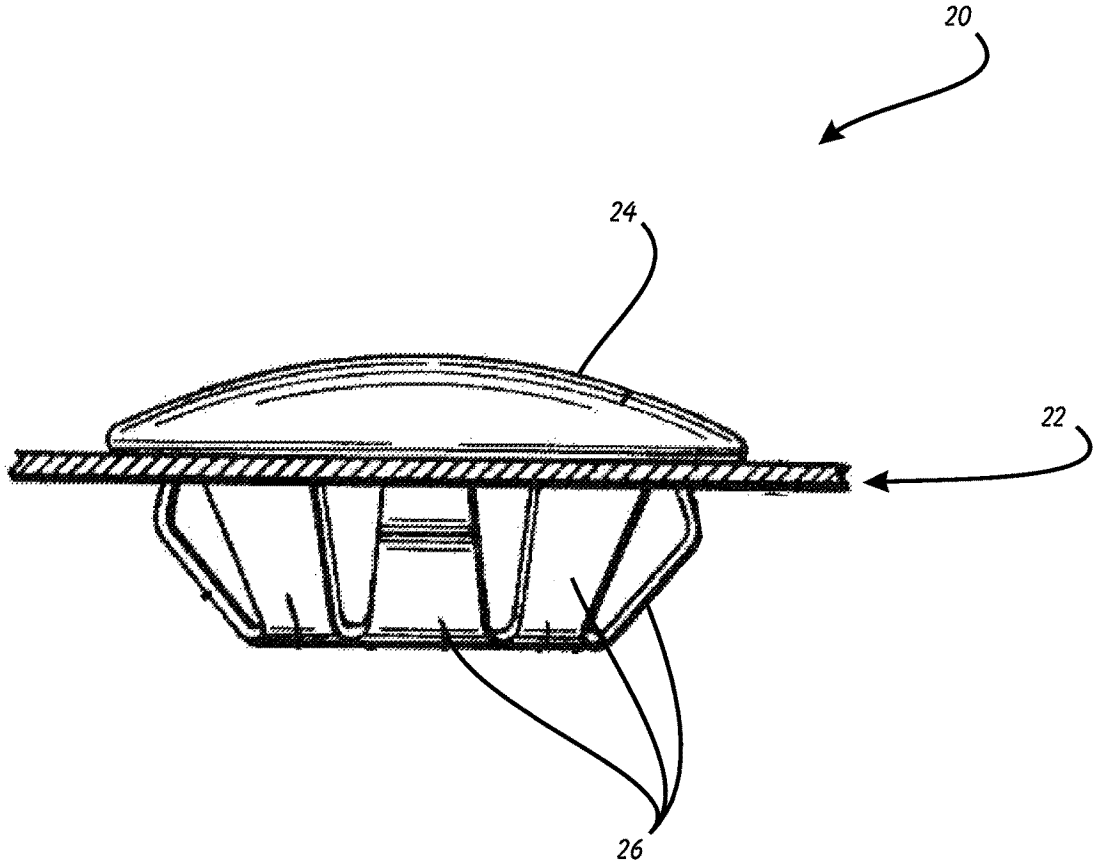
FIG. 2 PRIOR ART
FIG. 2 is a side view of a Universal Plug Button of U.S. Pat. No. 2,552,917 to P. D. Becker.
Figure 3:
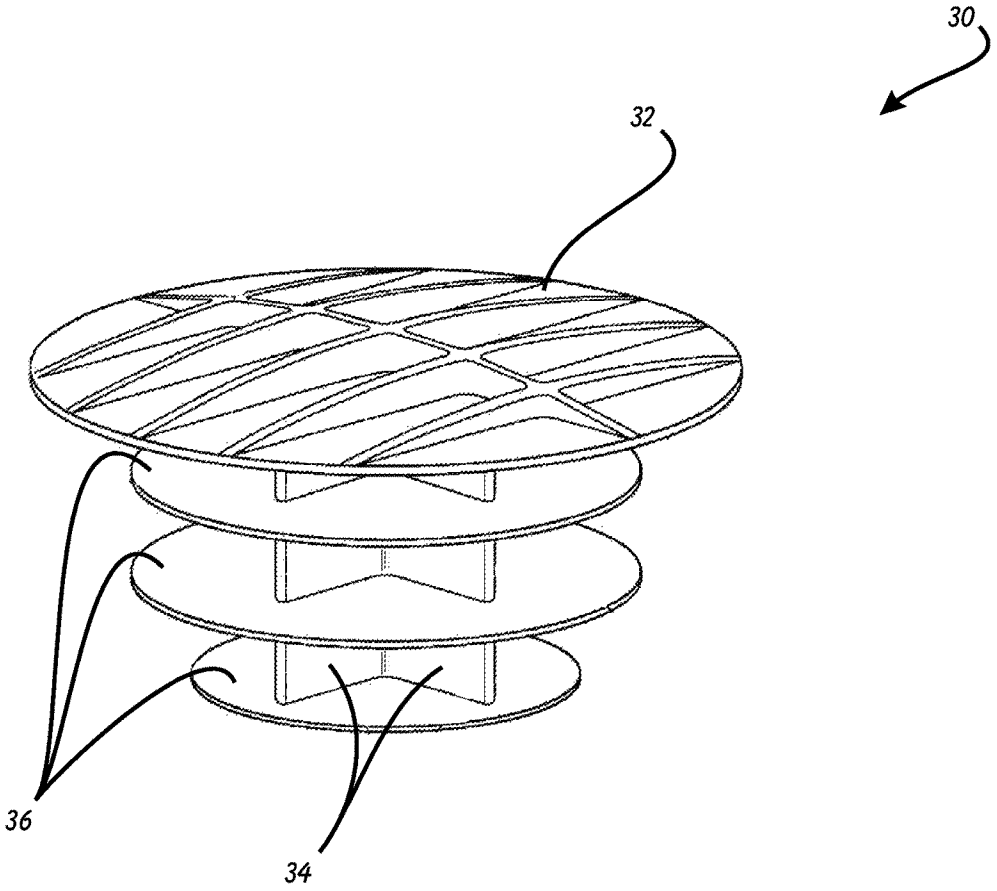
FIG. 3 PRIOR ART
FIG. 3 is a perspective view of a Stopper Device of U.S. Pat. No. 6,360,779 to Wagner, et al.
Figure 4:
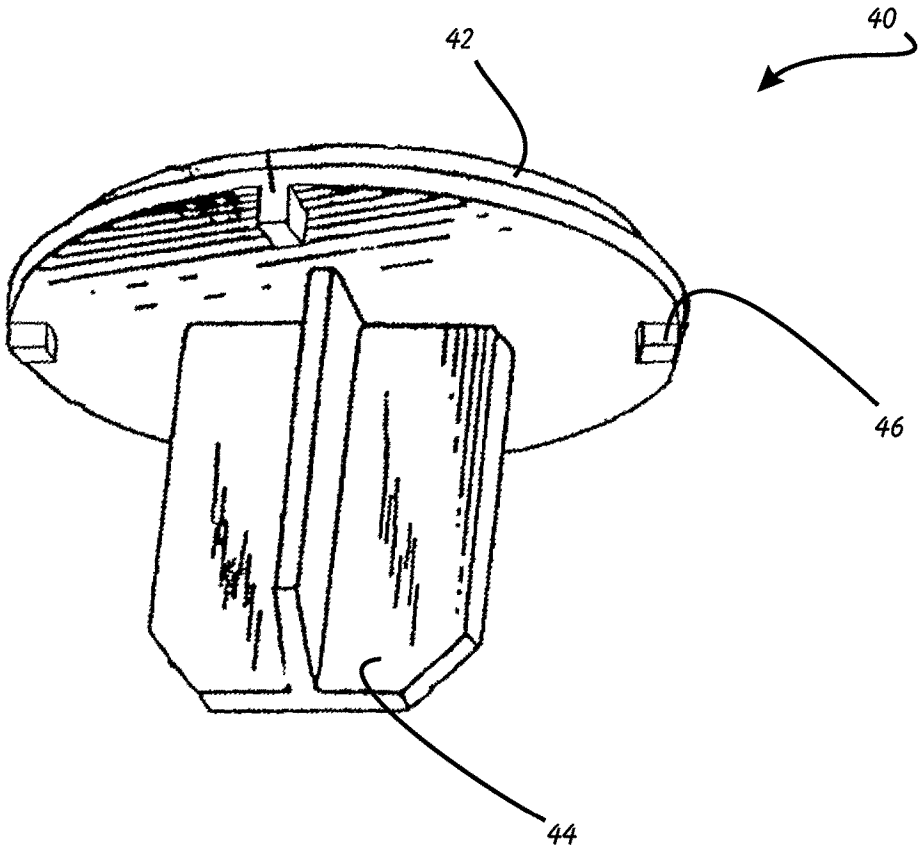
FIG. 4 PRIOR ART
FIG. 4 is a perspective view of a Plug of U.S. Pat. No. 7,581,361 to Murkland.
Figure 5:
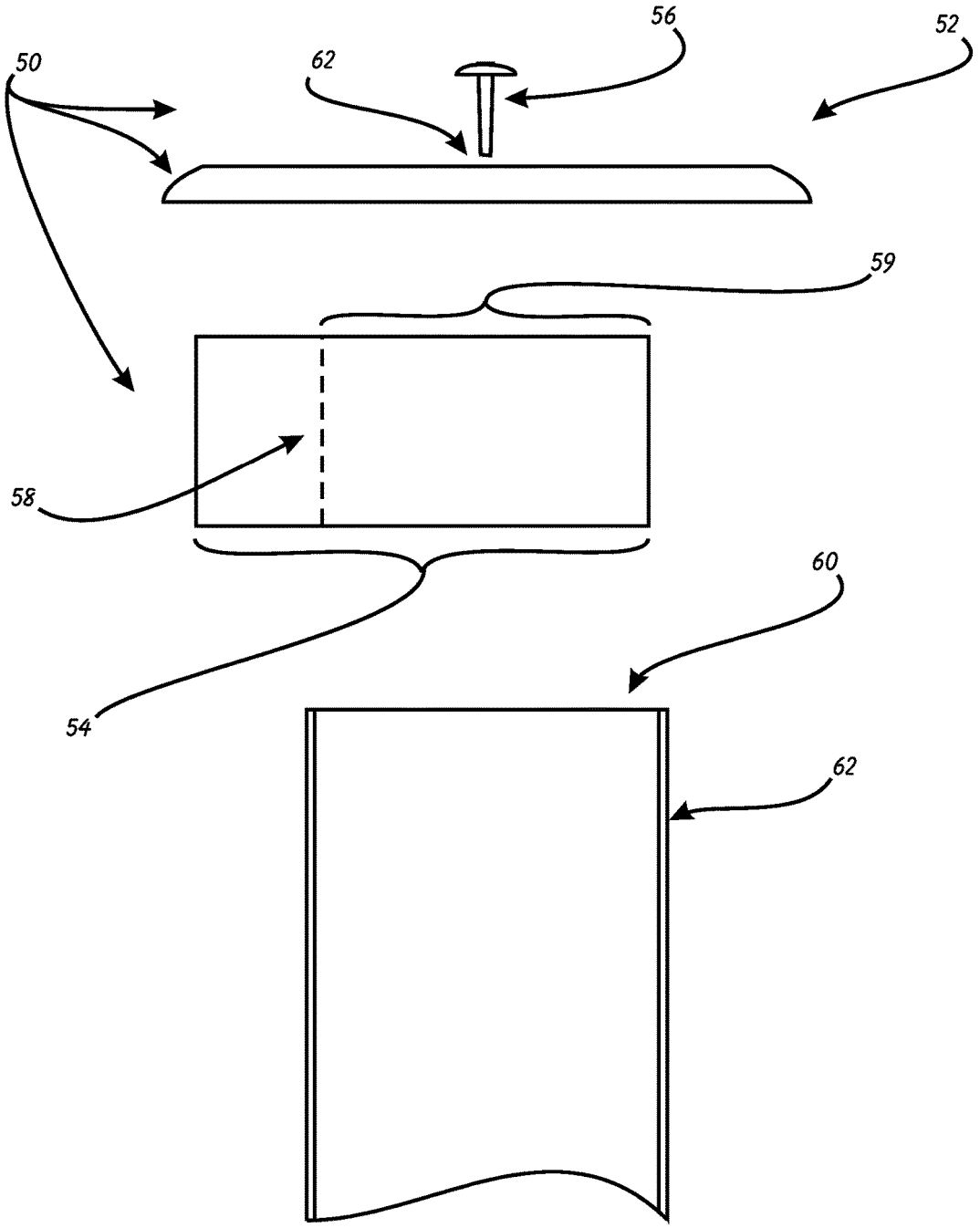
FIG. 5 is an exploded side view of a preferred embodiment of the adjustable hole plug of the present invention.

The present invention can best be understood by initial consideration of FIG. 5.[1] FIG. 5 is an exploded side view of a preferred embodiment of the adjustable hole plug 50 of the present invention. The cap element 52 is intended to be a mass-produced item that has an aperture 62 formed through it. The cap element 52 is intended to be attached to a stem portion 59 by a screw 56 passing through aperture 62 and into the stem portion 59.

[1] As used throughout this disclosure, element numbers enclosed in square brackets [ ] indicates that the referenced element is not shown in the instant drawing figure, but rather is displayed elsewhere in another drawing figure.

What is unique about this design is that the stem portion 59 is cut to fit the diameter of the bore 60 into which the user intends to cover with the cover 50. A block 54 of wood or other durable yet disposable material is cut at line 58 so that the block 54 will fit into the desired bore 60. The remaining portion—stem portion 59 is screwed to the cap element 52 by screw 56. This improvement lowers the overall cost of the hole plug 50 as compared to prior plugs, and further makes it much more versatile. A single cap element 52 can not only be re-used, it can be used and re-used for bores 60 of varying diameters. It is a simple matter of detaching and discarding the stem portion 59, and cutting another portion from off of another block 54, and then attaching the new stem portion 59 to the used cap element 52.

Figure 6A:
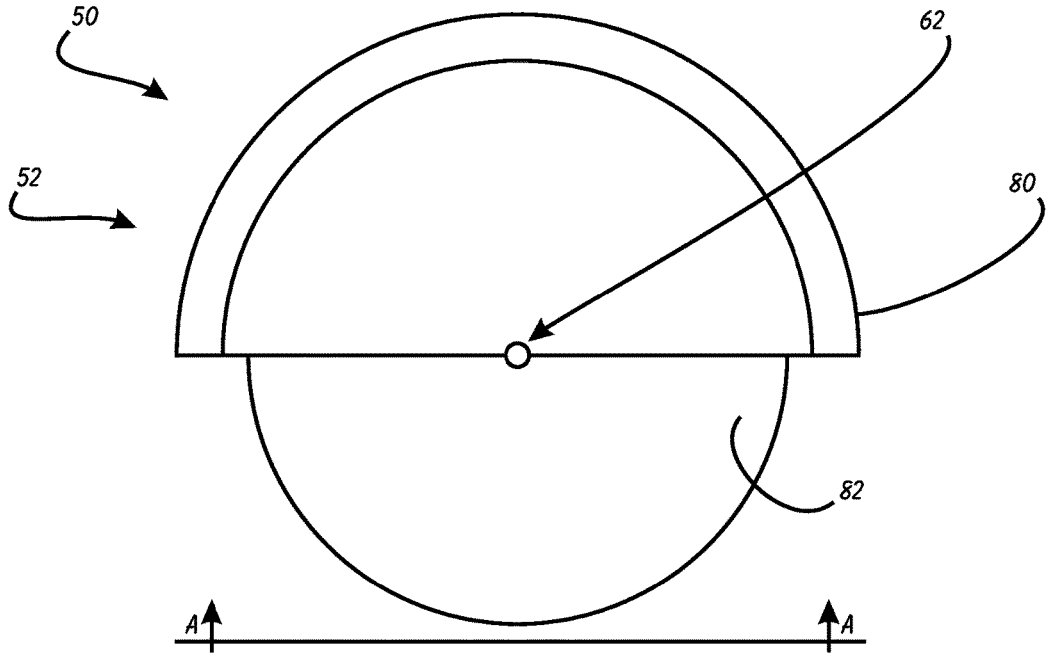
FIGS. 6A and 6B are cutaway top and side views, respectively, of the hole cover of FIG. 5.
Figure 6B:
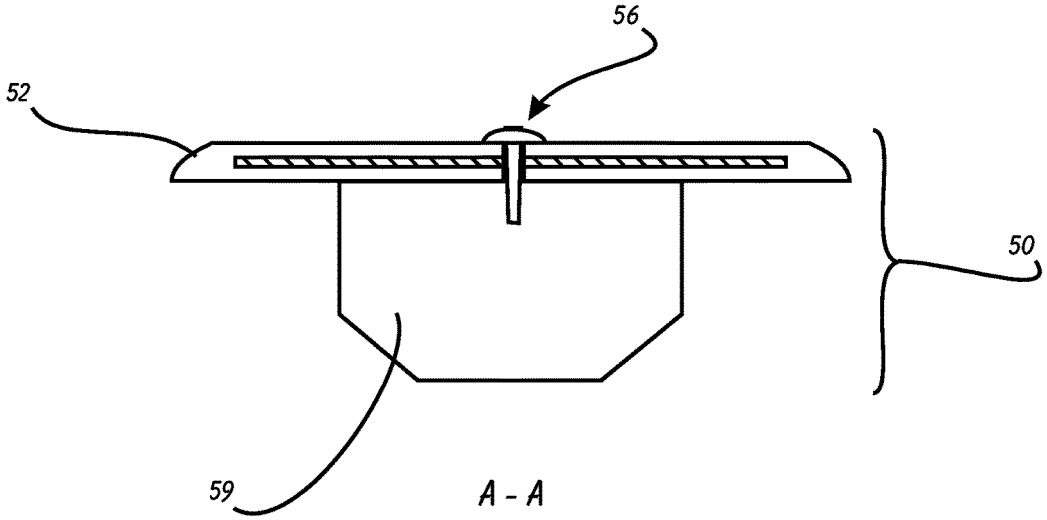

FIGS. 6A and 6B are cutaway top and side views, respectively, of the hole cover 50 of FIG. 5. This version of the cover 50 has a cap element 52 that is reinforced with a metal inner core 82 within a molded plastic outer shell 80. An aperture 62 is formed through both the shell 80 and the core 82 to accept the screw 56 (or other suitable conventional attaching element) therethrough.

Figure 7:
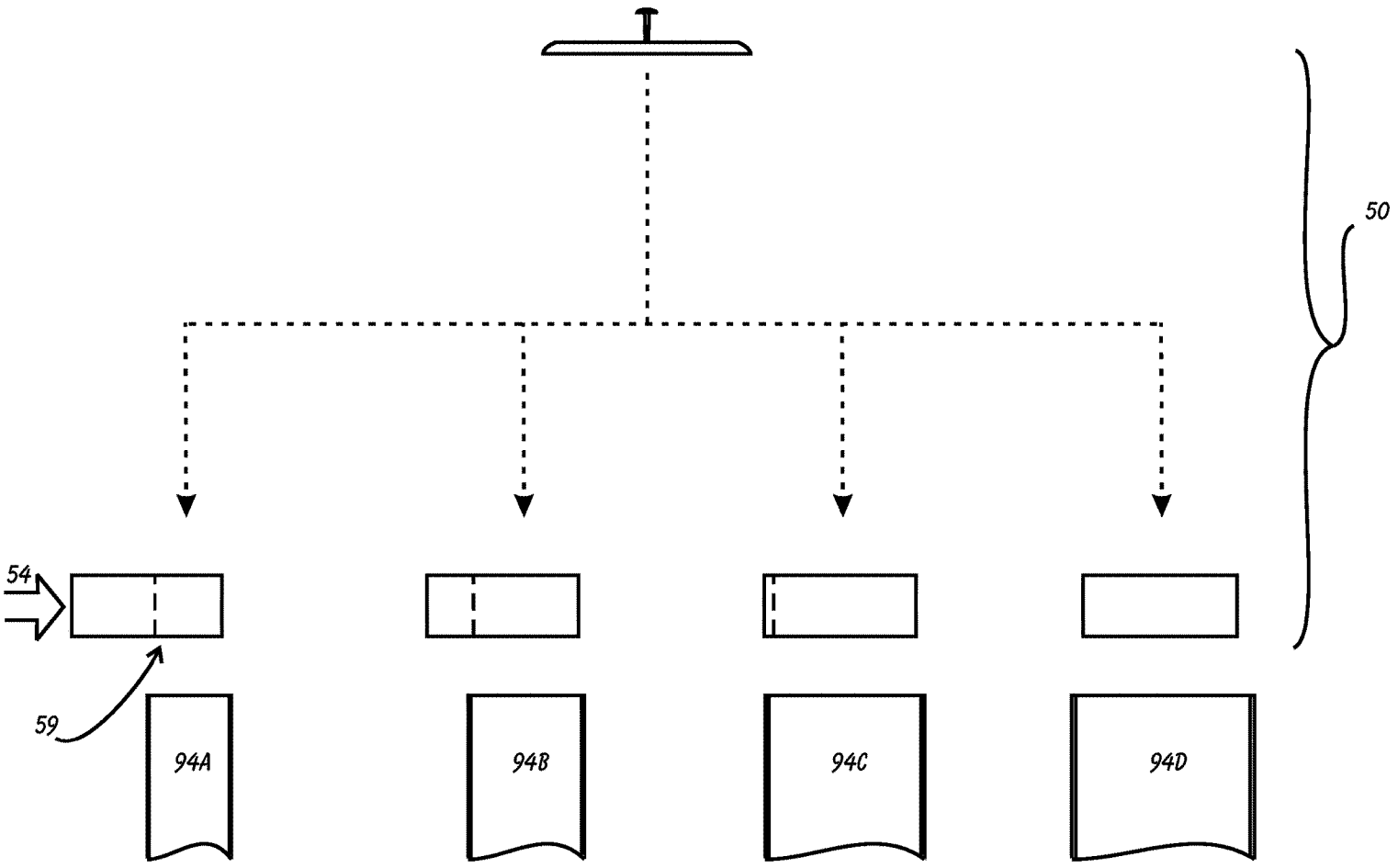
FIG. 7 is a plurality of side views of the hole cover of FIG. 5 as it can be adaptable to different sizes of bores.

FIG. 7 is a plurality of side views of the hole cover 50 of FIG. 5 as it can be adaptable to different sizes of bores. As shown in these side-by-side views, a single cap 10 element 52, screw 56 and block 54 can be used to cover a virtually unlimited series of different diameter bores or holes 94A, 94B, 94C and 94D. It is a simple matter of cutting the block 54 into the properly-sized stem portion 59.

Figure 8:
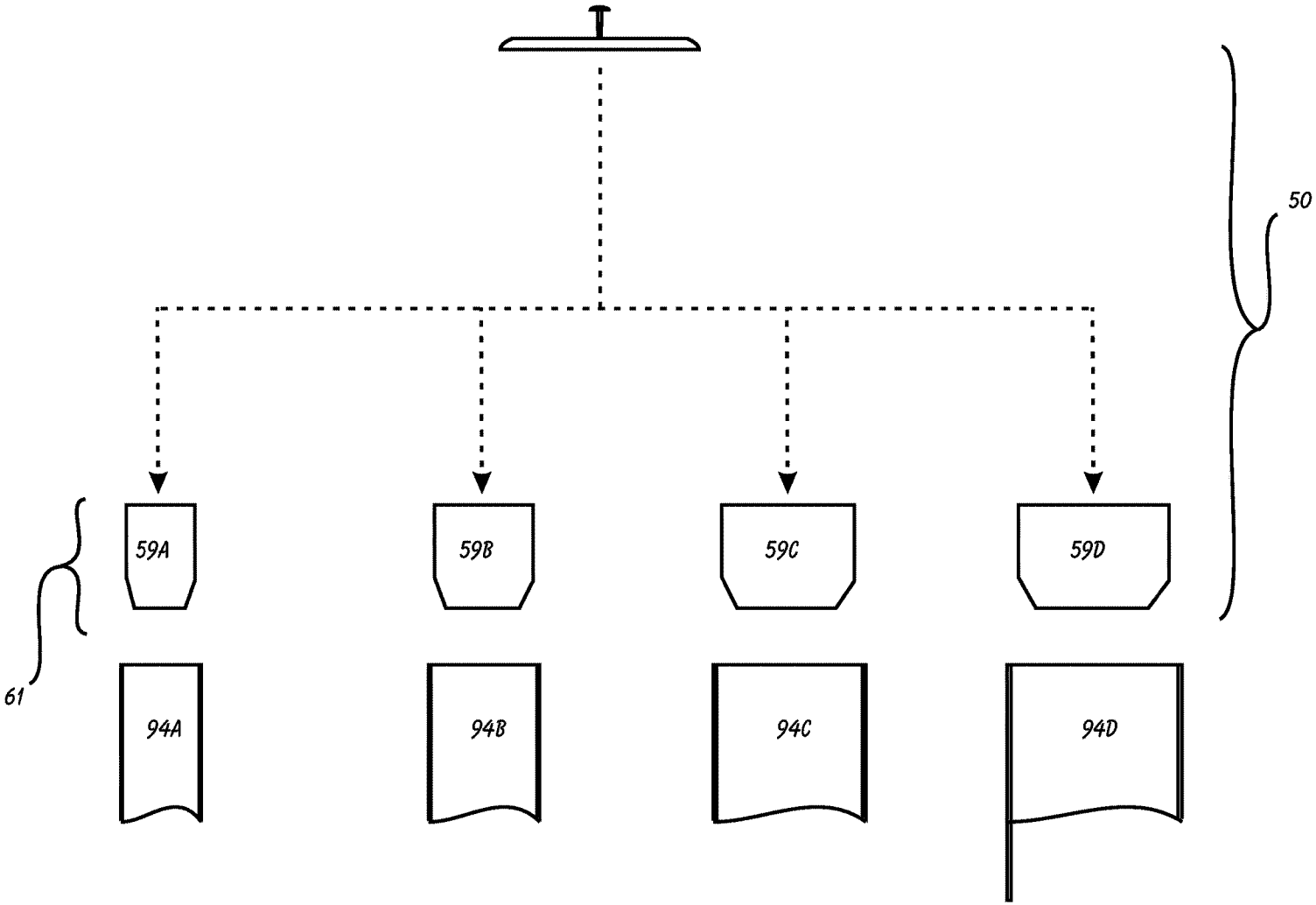
FIG. 8 is a plurality of side views of the hole cover of FIG. 5 where a kit of differently-sized stems is provided with a single cap element.

As shown in FIG. 8, the hole plug 50 could also be supplied with a group 61 of stems 59A, 59B, 59C, 59D that each define a different diameter. In this way, a single hole 15 plug 50 can be adapted to cover a variety of differently-sized holes 94A, 94B, 94C and 94D. As shown here also, the corners on one end of the stems 59A-59D could be cut into a tapered shape so that insertion into the bores 94A, 94B, 94C and 94D is made easier.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method for plugging holes of disparate diameters in a thick substrate having a top surface, the method comprising the steps of:

selecting a first hole having a first diameter;

creating a first hole plug for insertion into said first hole, said creating comprising:

obtaining a first cap element defined by a diameter that is greater than said first diameter, a top surface and an opposing bottom surface;

obtaining a first block defined by a width that is greater than or equal to said first diameter;

cutting said first block so that said width is less than said first diameter; and attaching said first block to said cap element; and inserting said first hole plug into said first hole, whereby said first block is inserted into said first hole and said cap element covers said first hole such that said bottom surface is resting atop said top surface of said substrate;

selecting a second hole having a second diameter, said second diameter being larger or smaller than said first diameter;

removing said first hole plug from said first hole;

detaching said first block from said first cap element obtaining a second block defined by a width that is greater than or equal to said second diameter;

cutting said second block so that said width is less than said second diameter;

attaching said second block to said first cap element to create a second hole plug; and inserting said second hole plug into said second hole, whereby said second block is inserted into said second hole and said first cap element covers said first hole such that said bottom surface is resting atop said top surface of said substrate.

2. The method of claim 1, wherein said first cap element of said first hole plug of said inserting steps has an outer shell formed from vinyl, rubber or plastic.

3. The method of claim 2, wherein said block of said first block obtaining step is made from material that is selected from a group that does not include vinyl, rubber or plastic.

4. The method of claim 1, wherein said first block attaching step comprises placing a threaded fastener through an aperture formed in said first cap element and threadedly engaging said first block located adjacent to said bottom side of said first cap element.

5. The method of claim 1, wherein said first block detaching step comprises removing a threaded fastener attaching said first block element to said first cap element.

6. The method of claim 5, wherein said second block attaching step comprises placing a threaded fastener through said aperture formed in said first cap element and threadedly engaging said second block located adjacent to said bottom side of said first cap element.

7. A method for plugging a hole in a thick substrate having a top surface, the method comprising the steps of:

selecting a first hole having a first diameter;

creating a first hole plug for insertion into said first hole, said creating comprising:

obtaining a cap element defined by a diameter that is greater than said first diameter, a top surface and an opposing bottom surface, said cap element defines an outer shell of vinyl, rubber or plastic;

obtaining a group of two or more wood blocks, wherein each of said blocks in said group defines a diameter that is less than said cap element diameter, and at least two of said blocks in said group have different diameters relative to one another;

obtaining a first block, said first block selected from said group of two or more wood blocks; and attaching said first block to said cap element; and inserting said first hole plug into said first hole, whereby said first block is inserted into said first hole and said cap element covers said first hole such that said bottom surface is resting atop said top surface of said substrate.

8. The method of claim 7, wherein said first block of said creating step is made from wood.

9. The method of claim 7, wherein said cap element of said creating step is made from a material chosen from a group of materials that includes vinyl, rubber and plastic.

10. The method of claim 7, wherein said cap element of said creating step further comprises a rigid core element substantially encased within said vinyl, rubber or plastic.

* * * * *